US007304612B2

(12) United States Patent
Grabner et al.

(10) Patent No.: US 7,304,612 B2
(45) Date of Patent: Dec. 4, 2007

(54) MICROSTRIP ANTENNA WITH INTEGRAL FEED AND ANTENNA STRUCTURES

(75) Inventors: John Grabner, Plano, TX (US); Richard Smith, Dallas, TX (US); Ed Condon, Murphy, TX (US)

(73) Assignee: Navini Networks, Inc., Richardson, TX (US)

( * ) Notice: Subject to any disclaimer, the term of this patent is extended or adjusted under 35 U.S.C. 154(b) by 78 days.

(21) Appl. No.: 11/214,505

(22) Filed: Aug. 30, 2005

(65) Prior Publication Data

US 2007/0035449 A1 Feb. 15, 2007

Related U.S. Application Data

(60) Provisional application No. 60/707,469, filed on Aug. 10, 2005.

(51) Int. Cl.
*H01Q 1/38* (2006.01)

(52) U.S. Cl. ..... 343/700 MS; 343/846

(58) Field of Classification Search ..... 343/700 MS, 343/702, 846
See application file for complete search history.

(56) References Cited

U.S. PATENT DOCUMENTS

| | | | | | |
|---|---|---|---|---|---|
| 4,051,477 | A * | 9/1977 | Murphy et al. | ..... | 343/700 MS |
| 5,355,143 | A * | 10/1994 | Zurcher et al. | ..... | 343/700 MS |
| 5,475,394 | A * | 12/1995 | Kohls et al. | ..... | 343/700 MS |
| 5,880,694 | A * | 3/1999 | Wang et al. | ..... | 343/700 MS |
| 5,977,710 | A * | 11/1999 | Kuramoto et al. | ... | 343/700 MS |
| 6,396,442 | B1 * | 5/2002 | Kawahata et al. | ... | 343/700 MS |
| 6,888,503 | B2 * | 5/2005 | Shikata | ..... | 343/700 MS |

* cited by examiner

*Primary Examiner*—Tan Ho
(74) *Attorney, Agent, or Firm*—K & L Gates

(57) ABSTRACT

A method and system is disclosed for a microstrip antenna module having an antenna structure with one or more radiating elements and an integral feed structure enclosing at least one transmission line, wherein the antenna structure and the feed structure share a ground plane.

13 Claims, 1 Drawing Sheet

MICROSTRIP ANTENNA WITH INTEGRAL FEED AND ANTENNA STRUCTURES

The present application claims the benefits of U.S. Patent Provisional Application No. 60/707,469, entitled "Microstrip Antenna With Integral Feed and Antenna Structures", which was filed on Aug. 10, 2005.

BACKGROUND

The invention is related to a design of microstrip antenna and particularly related to a microstrip antenna having an integral feed structure and multiple radiating elements.

In the field of wireless communication technology, an antenna is a component to receive and transmit electromagnetic wave. A good antenna can increase the efficiency, sensitivity and reliability of a wireless communication system. Hence, a good design of an antenna having high performance is an important part of the wireless communication system.

With the advancement of integrated circuit technology, the wireless products such as the mobile terminals become smaller in size. As they get small-sized and high-graded, newer antennas are desired. Microstrip antennas have been presented as one special research and product development area in the telecommunication field.

The concept of microstrip antennas was proposed in early 1950s, and became commercially viable in 1970s. A microstrip antenna is light, small and easy to be manufactured. Microstrip antennas can be easily attached to an object moving at a high speed. Because of these characteristics, microstrip antennas are widely applied on the fields of satellite communication, global positioning system, and low-power personal communication.

Typically, the microstrip antenna has a better efficiency when a dielectric constant becomes lower, and a substrate becomes thicker. Also, since the microstrip antenna has a high efficiency when using a high frequency, it can be considered as the very good choice for satisfying the miniaturization requirement for portable communication tool such as cell phones.

A microstrip antenna has several advantages. The first advantage is that the radiation of electromagnetic wave emits from a single side of the antenna so as to reduce the impact of electromagnetic wave on human body. Another advantage is that a microstrip antenna has a simple structure which is easy to construct. Another advantage is that the microstrip antenna can be designed on a circuit board together with solid-state modules such as an oscillator, amplifying circuit, variable attenuator, switch, modulator, mixer, or phase shifter. The microstrip antenna can also be manufactured at a low cost with a small size and a light weight, and thus it is suitable to mass production.

SUMMARY

The present invention provides a microstrip antenna that includes a non-conductive substrate, a conductive ground plane attaching to a first surface of the substrate, an integral feed structure mounted on the conductive ground plane enclosing at least one transmission line and isolating it from the ground plane, and a plurality of radiating elements mounted on a second surface of the substrate.

DESCRIPTION

Figure 1:
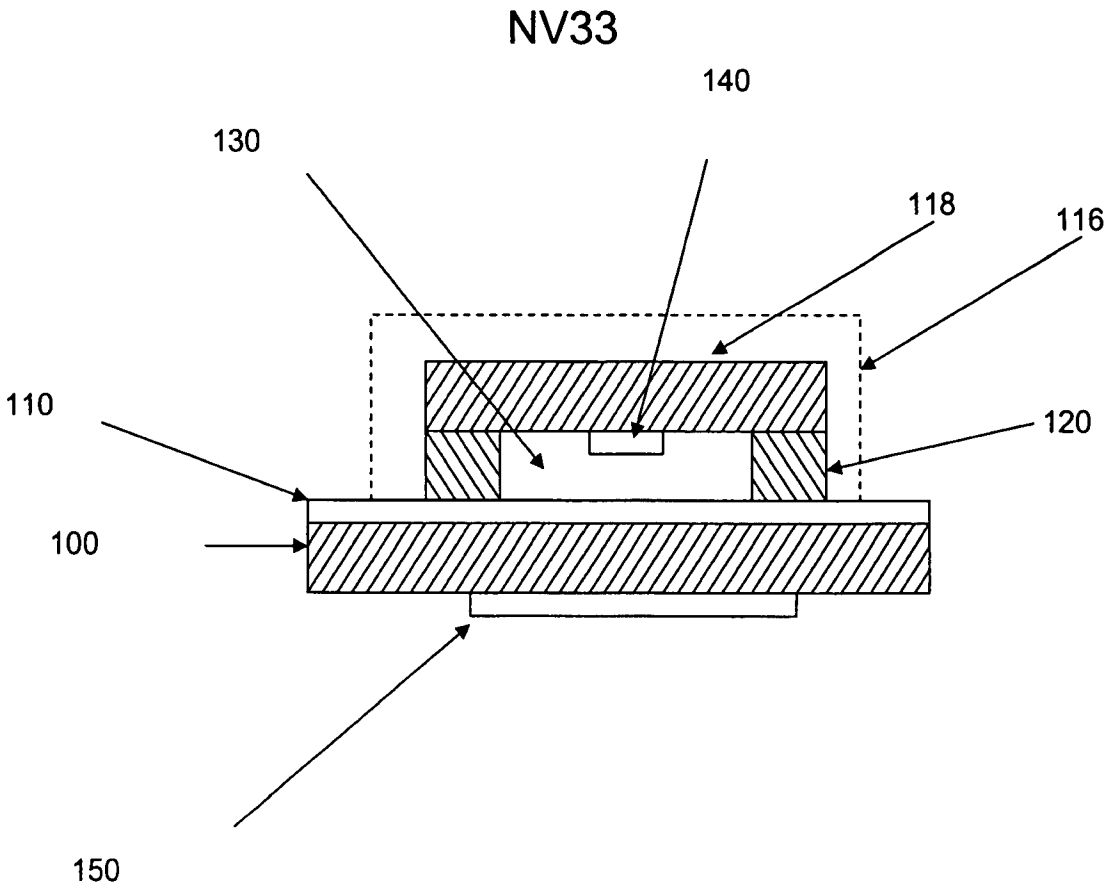
FIG. 1 shows a cross-section diagram of a microstrip antenna according to one embodiment of the present invention.

The present invention provides a microstrip antenna with an integral feed structure and multiple radiating elements. The integral feed structure is constructed on a conductive ground plane and is separated from the radiating elements.

Referring to FIG. 1, a microstrip antenna structure 200 is built on a substrate 100 composed of a dielectric material. For example, the substrate 100 can be a foam circuit board. It can also be a Teflon impregnated fiberglass weave microwave substrate material. A conductive ground plane 110 is placed on a first surface of the substrate 100 and an integral feed structure 116 is mounted on the substrate 100. The integral feed structure 116 has three components that enclose a space 130 between the substrate and itself. The integral feed structure 116 includes a supporting substrate 118, two sidewalls 120, and a transmission line 140. The supporting substrate 118 is non-conductive, as well as the two side walls 120, which can be made of dielectric materials such as the Teflon impregnated substrate material. It is understood that the supporting substrate and the two sidewalls can be fabricated as a single piece, but it can be three separate pieces attached to each other. For example, when Teflon materials are used, as they are not designed to be materials that are easily adhere to each other, some adhesion mechanism such as adhesive tapes are used to bound them. Furthermore, the transmission line 140 of the integral feed structure is mounted on the down surface or the interior surface of the supporting substrate 118, but not in contact with the substrate 100 or the ground plane 110. The air filled space 130 also serves as an isolating mechanism of the microstrip antenna 200 that separates the supporting substrate and the transmission line 140 from the conductive ground plane 110. It is understood that the space 130 can be filled with a predetermined dielectric material that is RF friendly so that it also provides the isolation function. For example some RF friendly foam may be used to fill this space.

One or more radiating elements 150 are mounted on the other surface of the substrate 100 and share the conductive ground plane 110 with the integral feed structure 116. The non-conductive substrate 100 separates the radiating elements 150 from the integral feed structure 116. There is an ohmic connection 160 such as a small via or connecting line that is placed between the radiating elements 150 and the transmission line 140 to connect them. The connection 160 can be placed through an aperture in the ground plane and the substrate. The location of the aperture or the connection 160 is specifically determined to avoid any significant interference to the function of the ground plane. It is understood that since the microwave current only occupies a very thin layer of the ground plane 110, the ground plane 110 can provide two such thin layers on two sides of it, one for the transmission line 140 and the other for the radiating element 150. The substrate 100 and the radiating elements 150 can be collectively referred to as an antenna structure. The integral feed structure 116 is placed in a predetermined location with respect to the conductive ground plane 110 and the radiating elements 150. The microwave signal is passed between radiating elements of the antenna structure and the transmission line of the feed structure. In one example, the radiating element is about 1.25 inches wide, the conductive ground plane 110 is about 0.4 inch wide, and the transmission line is about 0.18 inch wide.

The preferred embodiment of the present invention is a novel composition of a microstrip antenna, as stand alone or part of a linear antenna array, where each antenna structure is comprised of multiple radiating elements and a supporting substrate with a shared conductive ground plane.

The above illustration provides embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A microstrip antenna comprising:

a non-conductive substrate;

a conductive ground plane attaching to a first surface of the substrate;

an integral feed structure mounted on the substrate enclosing at least one transmission line and the ground plane, wherein the integral feed structure comprising a plurality of non-conductive sidewalls mounted on the substrate, and a supporting substrate mounted on the sidewalls, wherein the transmission line is mounted on a down surface of the supporting substrate so that it is isolated from the conductive ground plane; and one or more radiating elements mounted on a second surface of the substrate.

2. The microstrip antenna according to claim 1, wherein a space enclosed by the sidewalls and the supporting substrate is filled with a predetermined dielectric material.

3. The microstrip antenna according to claim 1, wherein a space enclosed by the sidewalls and the supporting substrate is filled with air.

4. The microstrip antenna according to claim 1, wherein the integral feed structure and the radiating elements share the ground plane.

5. An integral feed structure of a microstrip antenna comprising:

a plurality of dielectric sidewalls mounted on a first side of a substrate;

a supporting substrate mounted on the dielectric sidewalls; and a transmission line mounted on a surface of the supporting substrate and enclosed by the supporting substrate and the side walls and isolated from an enclosed ground plane.

6. The integral feed structure according to claim 5, wherein a space enclosed by the dielectric sidewalls and the supporting substrate serves as a non-conductive isolation material in the integral feed structure.

7. The integral feed structure according to claim 6, wherein the space is filled with air.

8. The integral feed structure according to claim 5 further comprising one or more radiating elements attached to a second side of the substrate sharing the ground plane and connecting to the transmission line through a connection placed through the substrate and the ground plane.

9. The integral feed structure according to claim 8, wherein the connection is a connecting line placed through a predetermined aperture in the substrate and the ground plane.

10. A microstrip antenna module with a feed structure and an antenna structure sharing a same ground plane, the module comprising:

an antenna structure having a non-conductive substrate with one or more radiating elements attached to a first surface thereof;

a ground plane whose first surface is attached to the substrate of the antenna structure;

an integral feed structure mounted on a second surface of the substrate enclosing at least one transmission line and isolating it from the ground plane, wherein the integral feed structure further includes:

a plurality of non-conductive sidewalls mounted on the substrate; and a supporting substrate mounted on the sidewalls with the transmission line mounted on a down surface of the supporting substrate so that it is isolated from the conductive ground plane.

11. The microstrip antenna according to claim 10, wherein a space enclosed by the sidewalls and the supporting substrate is filled with a predetermined dielectric material.

12. The microstrip antenna according to claim 10, wherein a space enclosed by the sidewalls and the supporting substrate is filled with air.

13. The microstrip antenna according to claim 10, wherein the integral feed structure and the radiating elements share the ground plane with a connection between the transmission line and the radiating elements.

* * * * *